United States Patent [19]

Rohde

[11] 3,957,590

[45] May 18, 1976

[54] VALVE ARRANGEMENT FOR COKE OVEN OFFTAKE CONDUITS

[75] Inventor: Wolfgang Rohde, Essen, Germany

[73] Assignee: Bergwerksverband GmbH, Essen, Germany

[22] Filed: May 20, 1974

[21] Appl. No.: 471,729

[30] Foreign Application Priority Data

May 19, 1973 Germany ..... 2325503

[52] U.S. Cl. ..... 202/258; 137/630; 137/630.15; 196/136; 202/256; 202/270

[51] Int. Cl.[2] ..... C10B 27/06; F16K 31/128

[58] Field of Search ..... 202/256, 258, 254, 255, 202/261–263, 270; 137/110, 630, 630.15; 196/136

[56] References Cited

UNITED STATES PATENTS

| | | | |
|---|---|---|---|
| 1,243,776 | 10/1917 | Stone | 202/262 X |
| 1,847,098 | 3/1932 | Otto | 202/258 |
| 2,004,266 | 6/1935 | Beimann | 202/256 X |
| 2,796,082 | 6/1957 | Green et al. | 137/630.15 |
| 2,879,799 | 3/1959 | Jansen et al. | 137/630.15 X |
| 2,975,109 | 3/1961 | Van Ackeren | 202/258 X |
| 3,382,895 | 5/1968 | McCullough | 137/630.15 |

*Primary Examiner*—Barry S. Richman
*Assistant Examiner*—Bradley R. Garris
*Attorney, Agent, or Firm*—Michael J. Striker

[57] ABSTRACT

In a coking oven, in which gas is withdrawn from a chamber through a conduit, a draft control is interposed in this conduit to regulate the pressure therein. The draft control comprises a first and a second throttle flap which are mounted in the conduit and which together cover part of the interior cross-section thereof, the remainder of the cross-section being blocked by a fixedly mounted element, and arrangements being provided for moving each of the throttle flaps individually between an open and a closed position.

6 Claims, 4 Drawing Figures

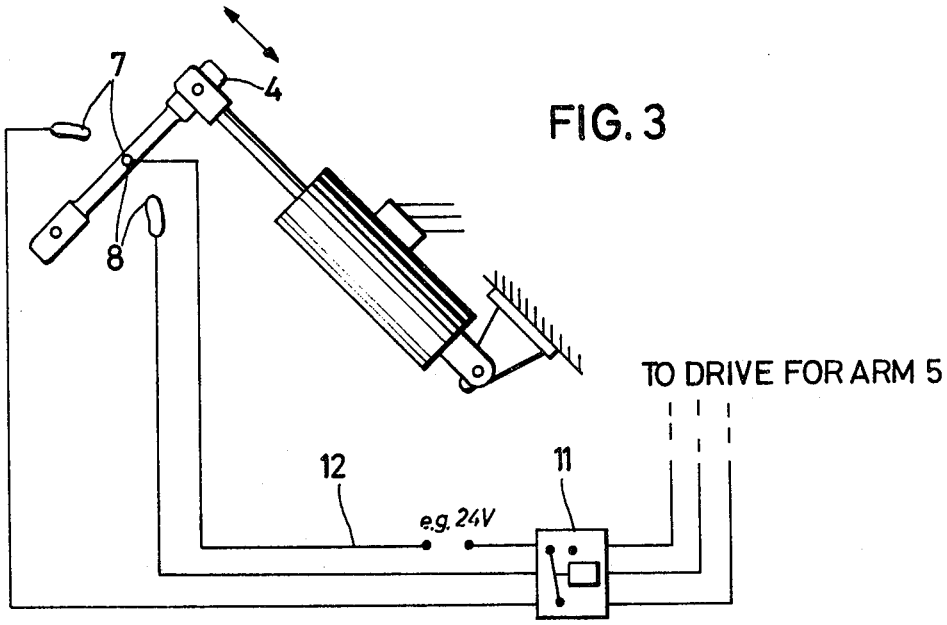
FIG. 3
FIG. 4
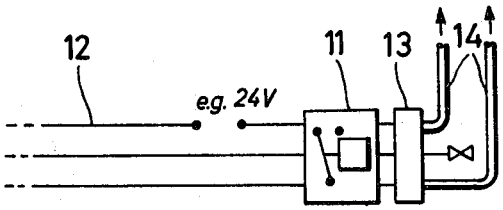

VALVE ARRANGEMENT FOR COKE OVEN OFFTAKE CONDUITS

BACKGROUND OF THE INVENTION

The present invention relates to coking oven constructions, and more particularly to an arrangement for providing a draft control in a coking oven construction.

The distillation gases and vapors which leave the coking oven chambers through the outlet conduits are usually collected in a collecting conduit, extending as a rule over the entire length of a battery of coking ovens. The gases must be cooled from their oven temperature of approximately 650°C to a much lower temperature of approximately 100°C. The purpose of providing the collecting conduit is to make it possible to mix, compensate and cool the differential amounts of gas which rise from the different coking oven chambers, and to eliminate as much as possible of the tar which is present in these gases.

The pressure existing in this collecting conduit is of great importance for the proper operation of a coking oven. As a rule, the gas is withdrawn from the coking oven in such a manner that a slight overpressure exists in the collecting conduit ahead of the draft control or throttle flap, to the extent of approximately 3–7 mm water column. The pressure which is required is selected and maintained by a regulating device which operates the throttle flap that is located at the beginning of each suction conduit communicating with the respective coking oven chamber.

As a general rule, the gas is withdrawn behind the throttle flap at a suction of approximately 100 mm water column, and it is clear from this that at this pressure differential the largest part of the suction conduit cross-section can be closed by a fixedly mounted blocking member, and that for purposes of effecting the regulation of pressure in the collecting conduit it is usually sufficient to install a relatively small throttling flap in this blocking member and which usually covers the approximately 15% of the total cross-sectional area of the suction conduit that is not blocked by the holding member. However, this involves certain disadvantages which have not yet been solved in the prior art. In particular, the requirements which are made of the accuracy of pressure regulation in the collecting conduit are very high, since a pressure which exceeds atmospheric pressure by only a few millimeters water column is to be maintained and, moreover, is to be maintained in such a manner as to be free of fluctuations over the entire coking period. The type of throttling flap heretofore used can meet this requirement only when it is in a certain position, or in a certain range of positions, approximately at a 45° open position. Assuming that the amount of gas flowing into the collecting conduit increases, which occurs quite frequently in operation of the coking chambers, then the throttle flap moves into or close to the "closed" position. When this takes place, a fluctuation-free regulation of the pressure in the collecting conduit is no longer possible, and the pressure in this conduit can then fluctuate by approximately ± 5 to ± 7 mm water column from the desired overpressure of, for instance, 3 mm water column. On the other hand, if the amount of gas flowing into the collecting conduit is substantially increased, for instance when preheated coal is introduced into the coking chambers, then the free cross-section of the conduit that can be exposed by the prior-art throttling flaps is no longer sufficient — even when the flap is in its fully open position — to permit the increased amount of gas to pass without causing an increase of the pressure in the collecting conduit.

SUMMARY OF THE INVENTION

Accordingly, it is a general object of the invention to overcome the disadvantages of the prior art.

More particularly, it is an object of the invention to provide an improved coking oven draft control which does not possess the aforementioned disadvantages.

In keeping with these objects, and with others which will become apparent hereafter, one feature of the invention resides, in a coking oven wherein gas is withdrawn from a chamber through a conduit, and a draft control is interposed in this conduit and regulates the pressure therein, the improvement wherein the draft control comprises a first and a second throttle flap mounted in the conduit and together extending over part of the interior cross-sectional area thereof, the remainder of the cross-sectional area being blocked by a fixedly mounted element. Means is provided for moving each of the throttle flaps individually between an open and a closed position.

The construction according to the present invention makes it possible to maintain the pressure in the conduit free of fluctuation, for instance at a prescribed pressure in excess of atmospheric between substantially 3 and 7 mm water column, even if extremely varying amounts of gas are derived from the coking oven chambers and enter the collecting conduit. The present invention is particularly advantageous if the operation of the coking ovens of a coking oven battery must be frequently changed over from the use of preheated coal to moist coal or vice versa, because the amount of gas which is liberated when preheated coal is used is substantially larger than the amount of gas that is liberated when moist coal is used. Other advantages are obtained by use of the present invention if, for instance due to disadvantageous suction conditions which may occur at the ends of the main suction conduit of a coking oven battery, the liberated gas can no longer be drawn properly through the small throttling flap of the prior art which corresponds to the smaller of the two throttling flaps of the present invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a circuit diagram showing an electric circuit associated with the embodiment of FIGS. 1 and 2; and FIG. 4 is a diagram showing a fluid circuit for use in this embodiment.

Figure 1:
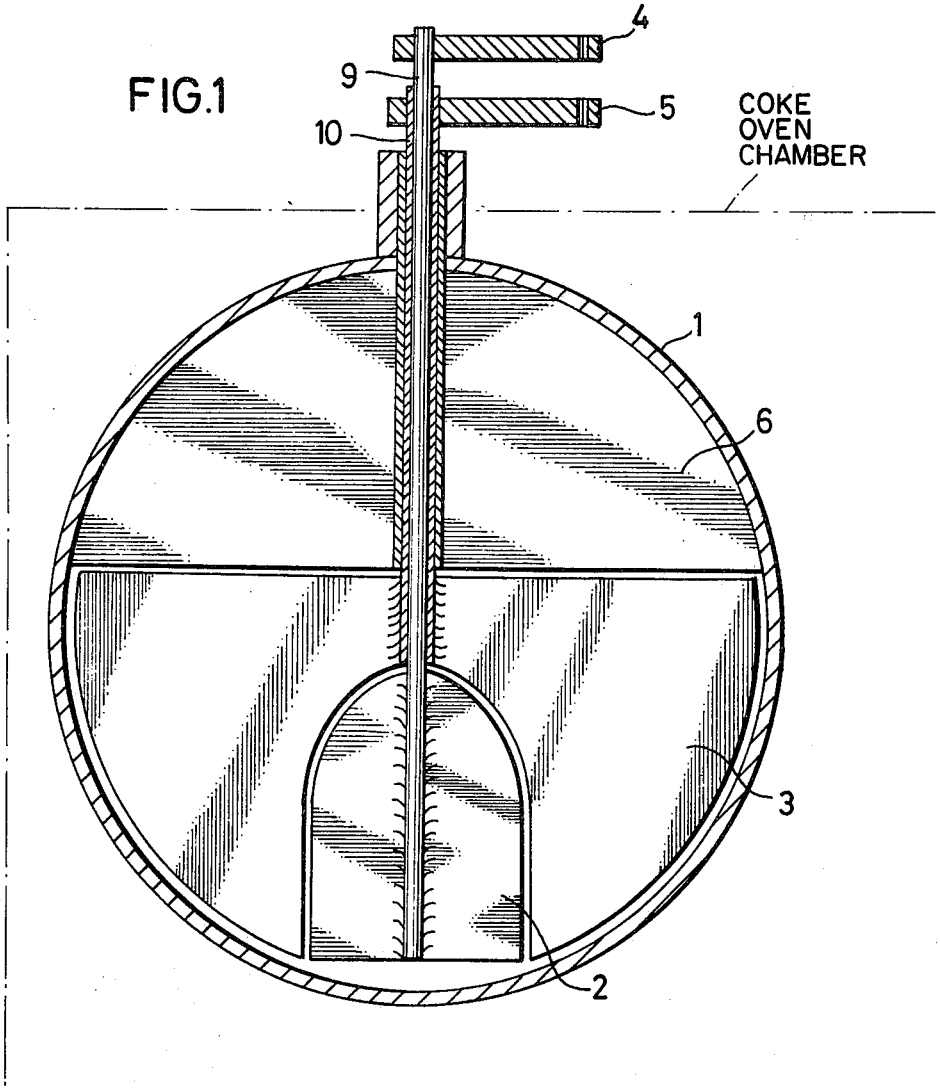
FIG. 1 is a section through a conduit of a coking oven battery, transverse to the longitudinal axis of the conduit and showing the novel arrangement.
Figure 2:
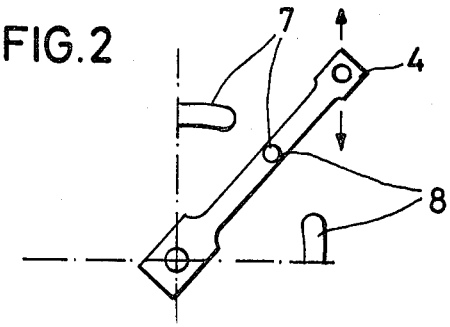
FIG. 2 is a plan view showing one of the operating levers of the arrangement of FIG. 1.

DESCRIPTION OF THE PREFERRED EMBODIMENTS:

Referring now to FIGS. 1 and 2 in detail, it will be seen that reference numeral 1 identifies a suction conduit of a coking oven battery, a chamber of which latter is fragmentarily and diagrammatically illustrated. A portion amounting to approximately 50–70%, currently 60% is preferred, of the cross-sectional area of the conduit 1 is covered by the two throttle flaps 2 and 3 together. The throttle flap 2 covers approximately one-quarter and the throttle flap 3 approximately three-quarters of this portion of the total cross-sectional area of the conduit 1. The remainder of the cross-sectional area, that is between substantially 30 and 50%, preferably 40% thereof, is covered by a fixed member 6, such as a sheet metal baffle or the like. The physical configuration of the throttle flap 2 can be varied at will. The two throttle flaps 2 and 3 are fixedly connected with respective coaxial mounting tubes 9 and 10, so that the flaps can turn about the longitudinal axis of the respective tubes 9 and 10, both of which are mounted for free turning movement.

For purposes of pressure regulation, the throttle flap 2 can be turned by the actuating lever 4 which acts upon its tube 9, and the flap 3 can be turned by the actuating lever 5 which acts upon its tube 10. The flap 3 is moved to change its position when the opening afforded by the throttle flap 2 in the fully "open" position thereof is no longer sufficient to maintain the pressure in the conduit 1 constant at the desired value.

In operation, the regulation of pressure in the conduit 1 may, for instance, require that the lever 4 first turn the throttle flap 2 from the 45°-open position to the fully open position, in which case the illustrated electric contact 7 will be closed. This causes the arm 5 to be moved in a sense slowly turning the flap 3 to its open position. As a result of this, the pressure in the conduit 1 will drop, so that the throttle flap 2 can be returned to its 45°-open position by means of the arm 4, whereby the latter interrupts the electric circuit which was previously closed by engagement with the contact 7. This, in turn, means that the flap 3 will not continue to open any further, but will remain in the position which it assumes at this point in time.

From now on, the further regulation of the pressure in the conduit 1 takes place exclusively via the throttle flap 2, as long as the quantity of gas which flows into the conduit 1 does not change significantly. If, for instance towards the end of the coking cycle, the gas pressure drops significantly, then the flap 2 will first move from its 45°-open position to its closed position, in which case the arm 4 will engage the electrical contact 8 (see FIG. 2), completing an electric circuit and causing the flap 3 to be moved by the arm 5 slowly towards closure position. This results in an increase of the pressure in conduit 1, so that the flap 2 is now returned via the arm 4 to the 45°-open position, disengaging the contact 8 and causing the flap 3 to be retained in its position which it has assumed at this time, until the next significant pressure fluctuation occurs. In this manner, the flap 2 will always be maintained in the optimum regulating position, in which it is displaced by approximately 45° from its fully closed position. Moreover, pressure fluctuations are avoided and the disadvantages of the prior art are eliminated.

The arms 4, 5 may be driven hydraulically, pneumatically or electrically. FIG. 3 shows an electrical drive for the arm 4, wherein a relay 11 is connected with the contacts 7, 8 via conductors 12 and is operated in dependence upon which of these contacts is engaged by the arm 4. The drive for the arm 4 receives impulses from a pressure regulating device (not shown) to which a reference pressure is constantly being supplied from an appropriate source. Such arrangements are known per se.

When the relay 11 operates in response to actuation by the arm 4, it in turn switches a further circuit which operates an electric drive for setting the arm 5. This latter drive operates as long as one of the contacts 7 or 8 is in closed (i.e. circuit-making) position. Thus, in dependence upon operation of the contacts by arm 4 and corresponding actuation of relay 11, the drive for arm 5 will be inoperative when contacts 7, 8 are open, will operate to move arm 5 in one direction when contact 7 is closed, or will operate to move arm 5 in the opposite direction when contact 8 is closed.

FIG. 4 shows that, in an arrangement similar to FIG. 3, the relay 11 could be used not to control an electric drive for arm 5, but to switch a fluid drive (i.e. pneumatic or hydraulic). In this case, actuation of relay 11 would serve to open or close an electromagnetic valve 13 (i.e. a three-way valve) which either prevents a flow of pressure fluid to arm 5 via conduits 14, permits a flow via one of these conduits to move arm 5 in one direction, or permits a flow of fluid via the other conduit 14 to move arm 5 in the opposite direction.

It will be understood that each of the elements described above, or two or more together, may also find a useful application in other types of constructions differing from the types described above.

While the invention has been illustrated and described as embodied in a coking oven arrangement, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a coking oven, having a chamber with a conduit for withdrawing gas from said chamber, a draft control interposed in said conduit and occupying a plane defining the internal cross-sectional area of said conduit for regulating the pressure therein, the improvement wherein said draft control comprises a fixedly mounted baffle means extending across a first portion of the internal cross-sectional area of said conduit, a flow control valve element extending across a second portion of the internal cross-sectional area of said conduit, a throttle flap element extending across a third portion of the internal cross-sectional area of said conduit and responsive to the pressure of gas in said chamber, and control means responsive to the movements of said throttle flap element and operable to open and close said flow control valve element.

2. In a coking oven as defined in claim 1, including the further improvement wherein said second portion is larger than said third portion.

3. In a coking oven as defined in claim 1, including the further improvement wherein said control means comprises first and second independently rotatably mounted coaxial shafts, said first shaft being connected to said flow control valve element and said second shaft being connected to said throttle flap element, for independently moving each of said elements to opened and closed positions.

4. In a coking oven as defined in claim 1, including the further improvement wherein said second and third portions constitute a portion amounting to substantially 60% of the internal cross-sectional area of said conduit.

5. In a coking oven as defined in claim 1, including the further improvement wherein said second and third portions together constitute a portion amounting to from 50% to 70% of the internal cross-sectional area of said conduit.

6. In a coking oven as defined in claim 5, including the further improvement wherein said second portion is three times larger than said third portion.

* * * * *